US008127857B2

(12) United States Patent
Sinnott et al.

(10) Patent No.: US 8,127,857 B2
(45) Date of Patent: Mar. 6, 2012

(54) SINGLE TRIP, TENSION SET, METAL-TO-METAL SEALING, INTERNAL LOCKDOWN TUBING HANGER

(75) Inventors: James A. Sinnott, Ralston (GB); Arlane P. Christie, Balmadie (GB); David A. Anderson, Newtonhill (GB)

(73) Assignee: Vetco Gray Inc., Houston, TX (US)

( * ) Notice: Subject to any disclaimer, the term of this patent is extended or adjusted under 35 U.S.C. 154(b) by 247 days.

(21) Appl. No.: 12/502,153

(22) Filed: Jul. 13, 2009

(65) Prior Publication Data

US 2011/0005774 A1 Jan. 13, 2011

(51) Int. Cl.
*E21B 23/00* (2006.01)
*E21B 23/01* (2006.01)

(52) U.S. Cl. ..... 166/382; 166/383

(58) Field of Classification Search ..... 166/382, 166/383; 277/339, 607
See application file for complete search history.

(56) References Cited

U.S. PATENT DOCUMENTS 5,311,947 A * 5/1994 Kent et al. ..... 166/348
5,653,289 A * 8/1997 Hosie et al. ..... 166/348

* cited by examiner

*Primary Examiner* — Kenneth L Thompson
*Assistant Examiner* — Cathleen Hutchins
(74) *Attorney, Agent, or Firm* — Bracewell & Giuliani LLP

(57) ABSTRACT

A system, apparatus, and method to apply tension to completion tubing in a wellbore. The system, apparatus, and method comprises an inner and outer tubing hanger, with the string of tubing attached to the inner tubing hanger. A running tool lands the outer tubing hanger on a landing shoulder and continues to lower the inner tubing hanger into the wellbore until the lower end of the inner tubing hanger latches into a retaining device. The running tool then sets a seal which holds the outer tubing hanger in position and causes a ratcheting mechanism to move to an engaged position. The running tool then withdraws the inner tubing hanger a predetermined distance until the inner tubing hanger engages the ratcheting mechanism.

20 Claims, 8 Drawing Sheets

SINGLE TRIP, TENSION SET, METAL-TO-METAL SEALING, INTERNAL LOCKDOWN TUBING HANGER

BACKGROUND OF THE INVENTION

1. Field of the Invention

The present invention relates in general to a method and apparatus to set and apply tension to casing or completion tubing in a wellbore, and in particular to a tubing hanger having an inner member and an outer member, and a running tool that sets the outer member, draws tension on the tubing by pulling the inner hanger, and then maintains the tension by locking the inner hanger into the outer hanger.

2. Brief Description of Related Art

Some wells, such as gas injection storage wells, have completion strings comprising tubing. The completion strings experience thermal expansion due to temperature variations when, for example, gas is injected into a storage well or withdrawn from a storage well. To compensate for the thermal expansion, the tubing may be placed under tension. With sufficient tension, the thermal expansion merely relaxes some of the tension. The travel distance associated with thermal expansion is less than the distance the tubing was stretched during the tensioning. Thus, even when the tubing expands due to increased temperatures, the tubing does not buckle within the wellbore.

Tensioning devices currently used on gas storage wells use retractable load shoulder arrangements which are often based on blow-out preventer designs. These designs require through-wall penetrations in the main pressure-containing housing, thus creating potential leak paths. This type of design also results in increased cost of the wellhead as the main housing material has to increase in diameter to accommodate the actuating mechanisms, which results in increased manufacturing costs and in addition, costs for the retractable load shoulder mechanism.

Modern well practice is to run various downhole safety valves and gauges through the wellbore. The existing retractable load shoulder type tensioning arrangement causes interference problems with the associated control lines descending below the tubing hanger.

Whilst the retractable load shoulder arrangement is relatively simple from a mechanical standpoint, it leads to the use of elastomeric materials to provide the main well bore seals. It is widely known that elastomeric materials degrade over time and given that gas storage facilities are usually planned to have long service lives (up to forty years), this seal degradation causes problems in later years.

SUMMARY OF THE INVENTION

A tubing hanger assembly is used to set and tension a string of tubing between a wellhead housing and a wellbore downhole tubing retaining device. A running tool is used to lower the tubing hanger and tubing into the wellhead housing. An outer portion of the tubing hanger lands in the wellhead housing and remains stationary. An inner portion of the tubing hanger, with a first end of the tubing attached, passes through the outer tubing hanger and is lowered until a second end of the tubing latches into the wellbore downhole retaining device. The running tool is pulled back, which lifts the inner tubing hanger and applies tension on the string of tubing. The inner tubing hanger latches into the outer tubing hanger as the inner tubing hanger is pulled up through the outer tubing hanger. The following is a more detailed description of the operation of an exemplary embodiment.

A tubing hanger assembly is attached to a tubing hanger running tool and lowered into a wellhead housing. A string of casing, or tubing, is suspended from tubing hanger assembly. The tubing hanger assembly comprises an outer tubing hanger and an inner tubing hanger. The outer and inner tubing hangers are initially held together by one or more shear pins.

The tubing hanger running tool lowers the hanger assembly until a shoulder of the outer tubing hanger lands on a wellhead housing shoulder. A ratchet ring, located within the outer tubing hanger, is held in a disengaged position, as will be explained subsequently, which allows further downward movement of the inner tubing hanger relative to the outer tubing hanger. The downward force of the conduit on the inner tubing hanger causes the shear pins to shear, thus freeing the inner tubing hanger from the outer tubing hanger. The operator continues to lower the tubing hanger running tool and inner tubing hanger, with the first end of the tubing still attached to the inner tubing hanger. A second end of the tubing latches into the wellbore downhole retaining device, such as a ratchet latch mechanism, which may be located within a gas storage well. The length of the tubing is calculated, in advance, so that the proper amount of tension is applied when the inner tubing hanger, and the attached tubing, is pulled back to the outer tubing hanger. Thus the running tool is advanced a predetermined distance from the point where the outer tubing hanger lands in the wellhead housing to the point where the second end of the tubing latches into the wellbore downhole retaining device.

After the second end of the tubing is latched into the retaining device, the operator stops the running tool and then installs a seal. To install the seal, the operator partially energizes a hydraulic ram arrangement associated with the tubing hanger running tool, which causes an energizing ring to push the seal into position between the outer tubing hanger and the wellhead housing body. The seal causes a lock ring to engage a lock ring groove on the wellhead housing body, thus preventing upward movement of the outer tubing hanger. The seal also pushes against a release pin, which causes the ratchet ring to collapse inward.

The running tool is pulled upward, which lifts the inner tubing hanger. As the inner tubing hanger is lifted, it moves upward relative to the outer hanger, applying tension to the section of tubing between the wellbore downhole retaining device and the wellhead housing. The ratchet ring ratchets on the external threads of the inner tubing hanger. The length of the tubing, and the distance of the pull of the running tool, are predetermined so that the desired amount of tension is reached when the inner tubing hanger is engaged by the ratchet ring. The ratchet ring holds the tension in the tubing by transmitting the load to the outer hanger and from there to the wellhead housing. The operator may then increase the hydraulic pressure on the ram to fully set the seal. The running tool is released from the outer hanger by rotation of the running tool. This results in the running tool unscrewing from lifting threads to allow retrieval.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Figure 1A:
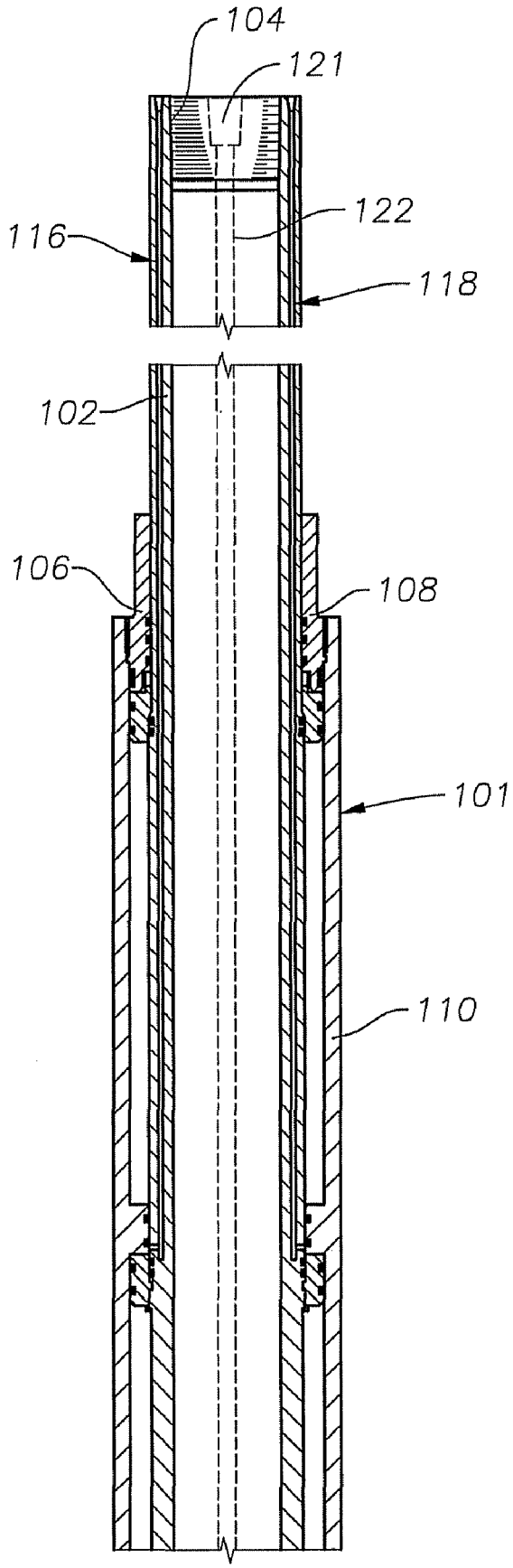
FIG. 1 is a sectional view of an exemplary embodiment of a running tool and internal lockdown tubing hanger system.
Figure 1B:
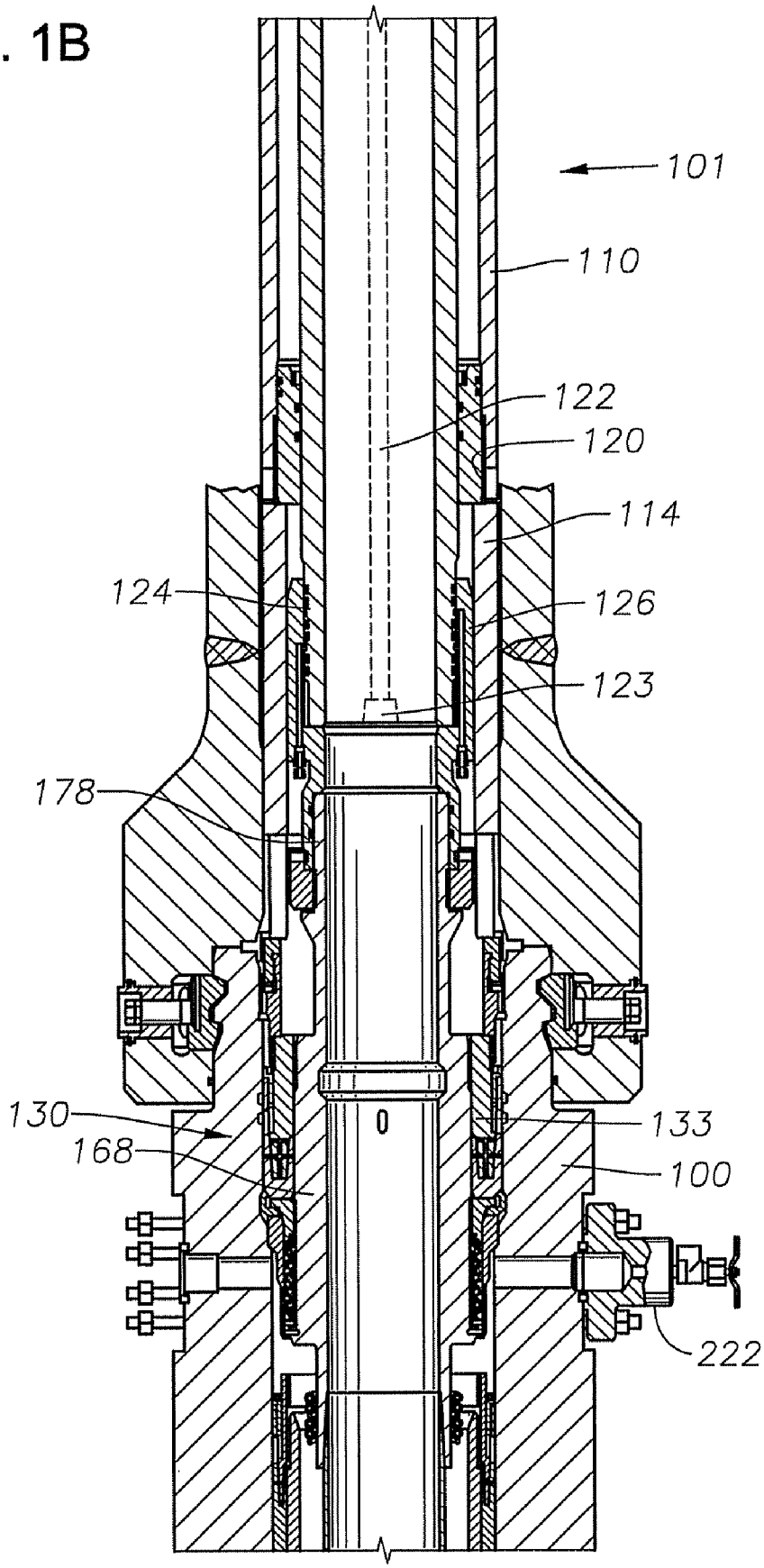

Referring to FIG. 1, wellhead housing 100 is supported above a wellhead or is located inside a wellbore. The wellhead may be a surface wellhead or a subsea wellhead.

Single trip running tool ("STRT") 101 comprises a generally cylindrical body 102 having threads 104 on a first end for attaching the STRT 101 to conduit such as a drill string (not shown). STRT 101 may have hydraulic pistons 106, 108 for actuating an energizing running tool outer body 110, which acts as a ram, for applying force to an adapter sleeve 114. In an exemplary embodiment, STRT 101 has two sets of hydraulic ports 116, 118 near the threaded end. The energizing hydraulic port 116 is connected to one or more hydraulic pistons 106 that cause running tool outer body 110 to axially extend along the length of STRT body 102.

The de-energizing hydraulic port 118, also located on the first end (the drill-string thread 104 end) of STRT 101, is connected to one or more hydraulic pistons 108 that cause the running tool outer body 110 to retract. When hydraulic pressure is applied through the de-energizing hydraulic port 118 to the de-energizing hydraulic pistons 108, the pistons cause the running tool outer body 110 to retract axially along the length of STRT 101, towards drill string threads 104. In an exemplary embodiment, running tool outer body 110 is able to travel an axial distance of 1.2 meters relative to STRT body 102. The force exerted by the energizing pistons 106 is determined by the amount of hydraulic pressure applied to the pistons. In some embodiments, the hydraulic pressure may be 9,000 psi or more. STRT running tool outer body 110 has connectors 120 for attaching to an adapter sleeve 114. In a preferred embodiment, the connector 120 is a thread profile.

The first end of STRT may have connectors 121 for connecting hydraulic lines to pass-through passages 122. The second end of passages 122 may have fittings or connectors 123. Connectors 123 may attach to similar fittings on, for example, the comm collar 126.

The second end of the STRT body 102 has connectors 124 for connecting STRT 101 to another component, such as comm collar 126 or a tubing hanger assembly 130. Connector 124 may be a threaded connector having threads on the ID of the second end of the STRT body 102. In such embodiments, operator lands STRT 101 on comm collar 126 and then rotates 8-9 turns in the right-hand direction to make up STRT 101 and comm collar 126. After comm collar 126 is attached to STRT body 102, torque keys (not shown) may be used to prevent comm collar 126 from rotating on the STRT 101. In an exemplary embodiment, STRT 101 is an extended version of a commercially available running tool, Vetco Gray part number R117920-1.

Figure 2:
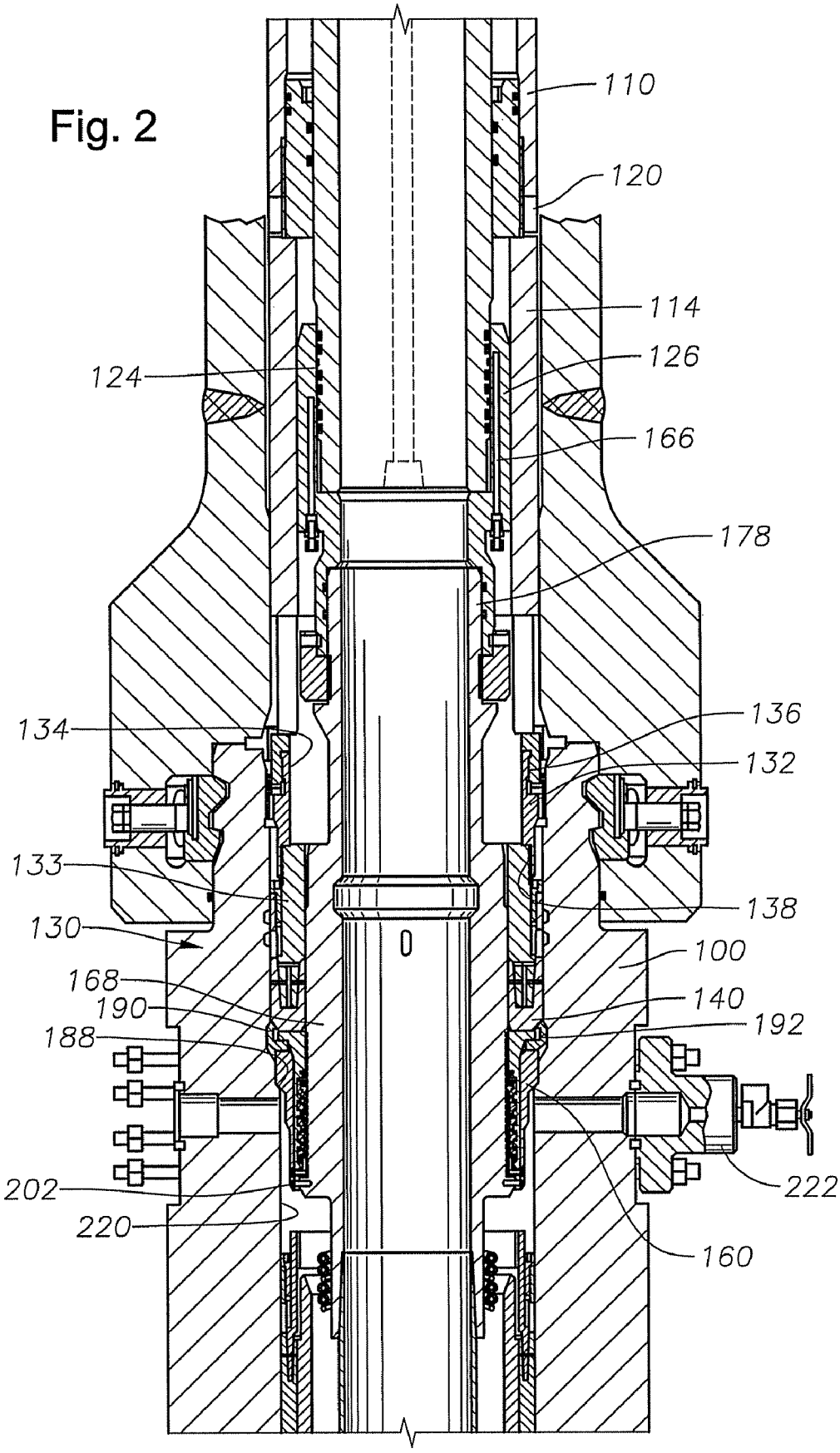
FIG. 2 is a sectional view of an exemplary embodiment of the running tool of FIG. 1.

Referring to FIG. 2, adapter sleeve 114 is an annular sleeve attached at a first end to the running tool outer housing 110 on the lower end of STRT 101 (FIG. 1). The second end of adapter sleeve 114 is attached to seal releasing latch ring 132. The inner diameter of adapter sleeve 114 is larger than the outer diameter of comm collar 126, allowing the adapter sleeve 114 to pass over the outside of comm collar 126.

Seal releasing latch ring 132 is an annular ring connected between adapter sleeve 114 and the energizing ring 133. Threaded connectors 134 on the second end of the seal adapter sleeve 114 attach to mating threaded connectors 136 on seal releasing latch ring 132. In an exemplary embodiment, adapter sleeve 114 is attached to the seal releasing latch ring 132 by threads having a left-hand rotation and is locked in place by a series of locking screws (not shown) to prevent detachment during operation. A slotted left-hand thread profile 138 located at the lower end of seal releasing latch ring 132 is used to connect to seal assembly 140. The slotted left-hand thread profile 138 allows the tubing hanger running tool to disconnect from the seal by straight upward movement.

Figure 3:
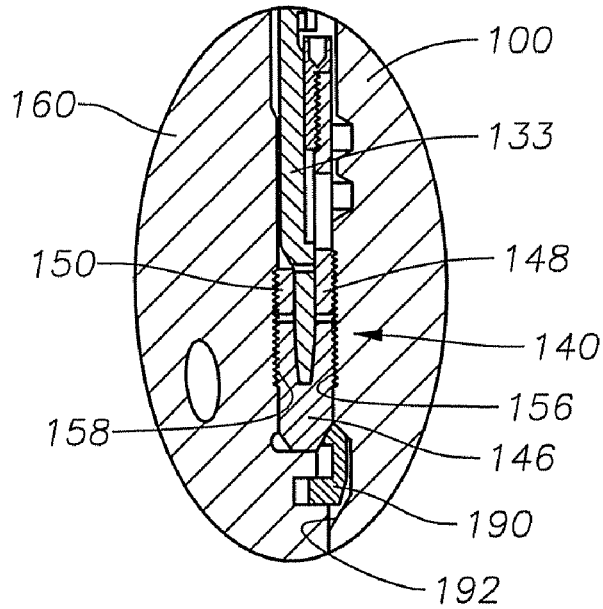
FIG. 3 is a detail view of the seal and lockdown ring of the tubing tensioning system of FIG. 1.

Referring to FIG. 3, seal assembly 140 is releasably carried by seal releasing latch ring 132 (FIG. 2). Seal assembly 140 lands in the pocket between wellhead housing 100 exterior wall and tubing hanger inner body 174. Seal assembly 140 is made up entirely of metal components. These components include a generally U-shaped seal member 146. Seal member 146 has an outer wall or leg 148 and a parallel inner wall or leg 150, the legs 148, 150 being connected together at the bottom by a base and open at the top. The inner diameter of outer leg 148 is radially spaced outward from the outer diameter of inner leg 150. This results in an annular clearance between legs 148, 150. The inner diameter and the outer diameter are smooth cylindrical surfaces parallel with each other. Similarly, the inner diameter of inner leg 150 and the outer diameter of outer leg 148 are smooth, cylindrical, parallel surfaces.

Energizing ring 133 is employed to force legs 148, 150 radially apart from each other into sealing engagement with sealing surfaces 156, 158. Sealing surfaces 156, 158 may be any kind of sealing surface including, for example, wickers. Energizing ring 133 has an outer diameter that will frictionally engage the inner diameter of the seal outer leg 148. Energizing ring 133 has an inner diameter that will frictionally engage the outer diameter of the seal inner leg 150. The radial thickness of energizing ring 133 is greater than the initial radial dimension of the clearance of the clearance between seal legs 148, 150. The energizing ring 133 pushes the seal legs apart, causing the seal legs to compressively engage the sealing surfaces 156, 158 on wellhead housing 100 and tubing hanger inner body 174.

Figure 4:
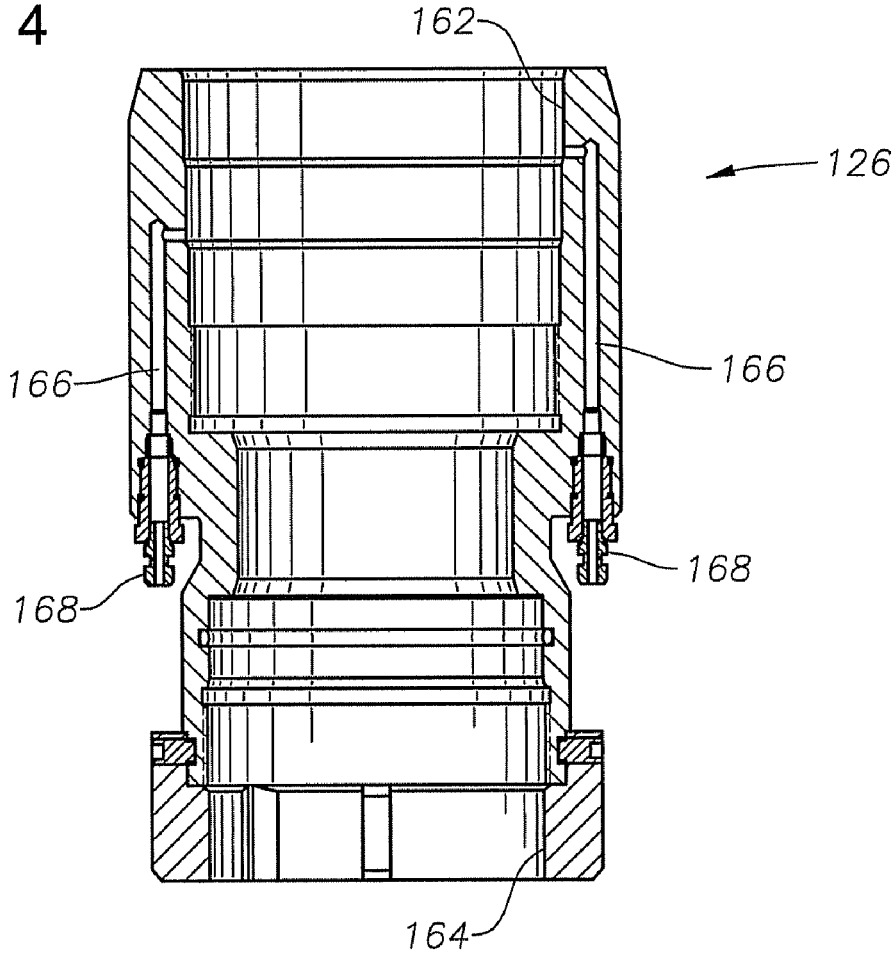
FIG. 4 is a sectional view of the communication collar of the tubing tensioning system of FIG. 1.

Referring to FIG. 4, communication collar ("comm collar") 126 is an annular sleeve that may be connected to STRT body 102 (FIG. 1). The upper end of comm collar 126 has a connector 162 such as a threaded connector for attaching the comm collar 126 to corresponding connectors 124 on STRT body 102 (FIG. 1). The lower end of the comm collar 126 has connectors 164 such as threaded connectors.

Referring to FIG. 2, comm collar 126 is attached to tubing hanger elongated neck 178 by right-hand threads. An anti-rotation device, such as anti-rotation bushings or torque keys (not shown) may be used to prevent the comm collar 126 from rotating in relation to the tubing hanger Referring back to FIG. 4, comm collar 126 may have tubes or passages 166 through the collar and fittings 168 suitable for attaching lines such as hydraulic lines at the lower end of the tubes or passages 166. A hydraulic hose (not shown) from the surface may be attached to hydraulic port 118 on STRT 101. A second hydraulic hose (not shown) may be attached to fitting 168 at the second end of the tube or passage. The second hydraulic hose may descend through the wellbore. In some embodiments, other types of lines may be connected through the comm collar 126, such as signal lines or power lines.

Figure 5:
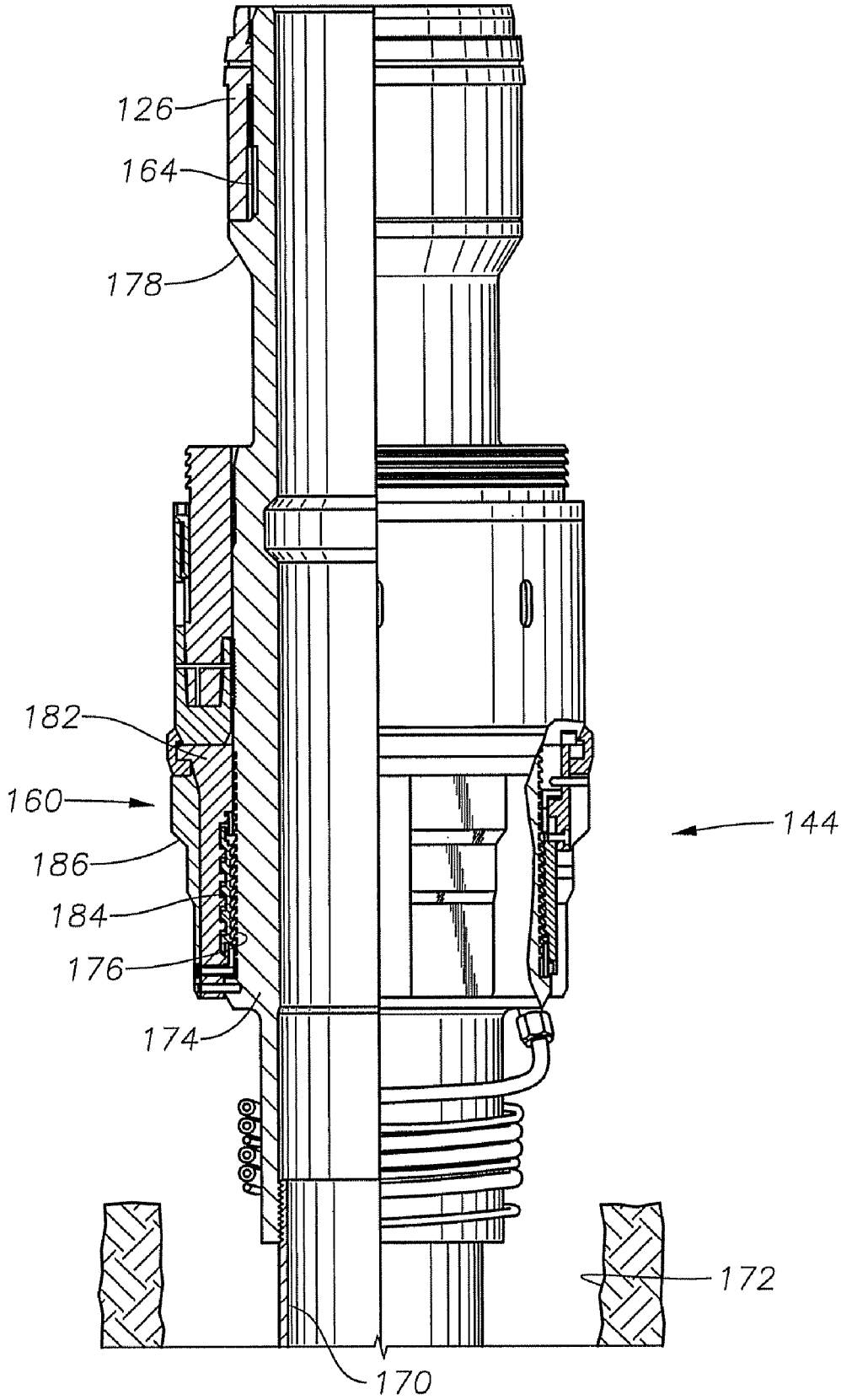
FIG. 5 is a sectional view of the tubing hanger of the tubing tensioning system of FIG. 1.

Referring to FIG. 5, a string of tubing 170 is lowered through a wellhead housing assembly 100 (FIG. 2) and into a wellbore 172 located below wellhead housing 100. Inner tubing hanger 174, a cylindrical member, is connected to the top of string of tubing 170 and becomes a part of the string of tubing 170. Inner tubing hanger 174 is also part of tubing hanger assembly 130, and may be considered an inner hanger portion of a tubing hanger. Inner tubing hanger 174 has a set of external grooves 176, which are formed by parallel circumferential ridges on the outer diameter of inner tubing hanger 174. Inner tubing hanger 174 has an elongated neck 178, which protrudes above tubing hanger outer body 160. Elongated neck 178 may be attached to connector 164 of comm collar 126.

The tubing string 170 suspended from the tension set tubing hanger comprises a typical tubing that is well known in the art. The second end of the tubing (the end opposite the tubing hanger) is latched to a subsurface fixture by a conventional latching mechanism. In an exemplary embodiment, the lower end of the tubing is latched using a ratcheting locking device ("ratch-latch").

Outer hanger 160, a cylindrical member, is carried on inner tubing hanger 174, forming a second part of a tubing hanger assembly 130. Outer hanger 160 includes a load ring 182 and a ratchet ring 184. Load ring 182 has a downward facing landing shoulder 186 for landing on wellhead housing assembly load shoulder 188 (FIG. 2). Ratchet ring 184 is carried within an inner recess in load ring 182 for engaging the inner tubing hanger threads 176.

Referring to FIG. 3, lockdown ring 190, which can be a split ring, will engage groove 192 in wellhead housing assembly 100 to latch load ring 182 in place. Lockdown ring 190, which is inwardly biased, does not engage groove 192 in wellhead housing assembly 100 in its relaxed state. A chamfer on the lower surface of seal 146 engages a chamfer on the upper surface of lockdown ring 190 when the seal 146 is set in place by the energizing ring 133. The seal causes the lockdown ring 190 to expand and engage the groove 192 on wellhead housing assembly 100, and remain engaged as long as the seal 146 remains set in place.

Figure 6:
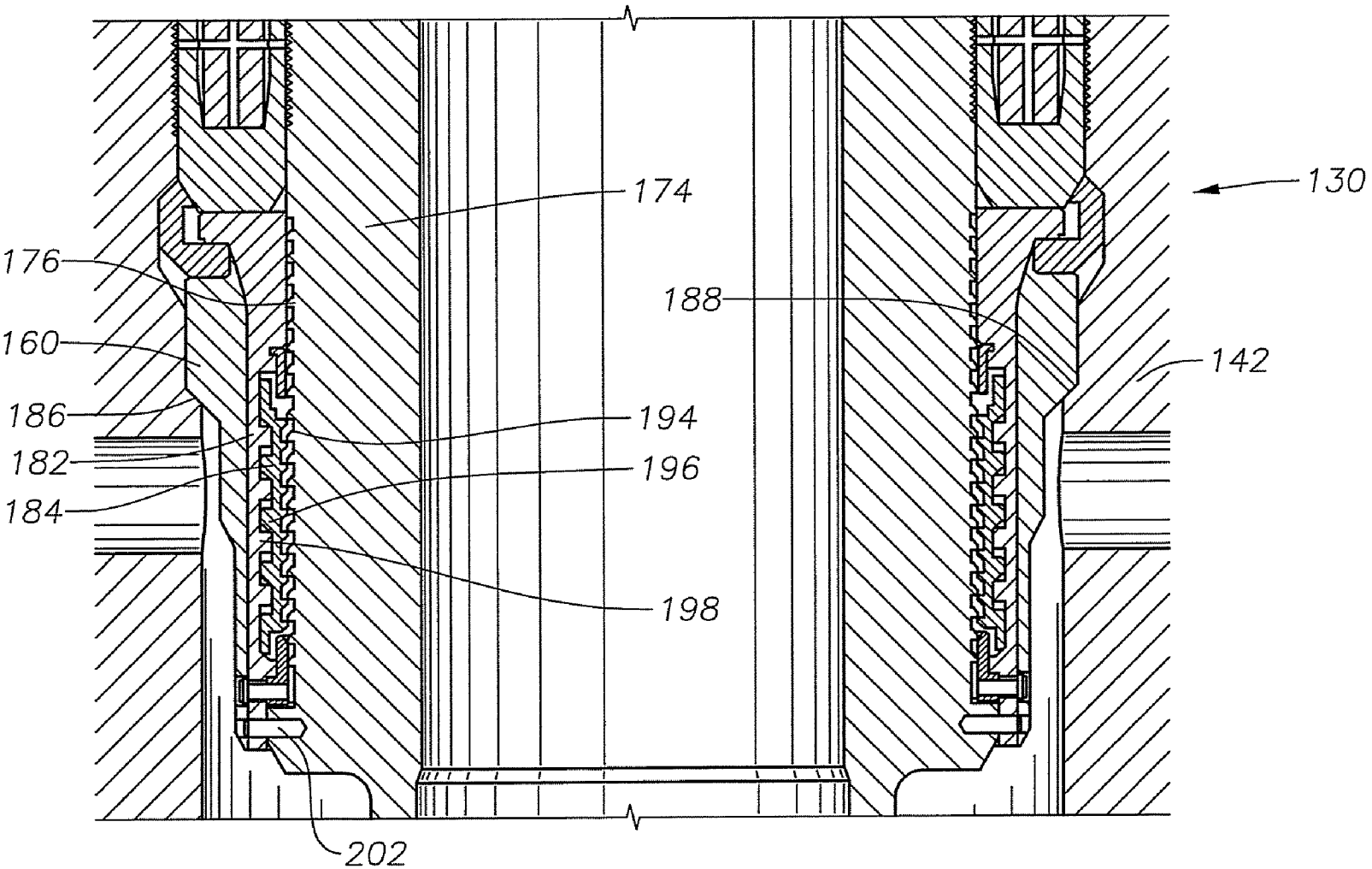
FIG. 6 is a sectional detail view of the locking mechanism of the tubing tensioning system of FIG. 1.

Referring to FIG. 6, ratchet ring 184 is a modified version of the ratchet ring shown in U.S. Pat. No. 4,607,865, David W. Hughes, issued Aug. 26, 1986. Ratchet ring 184 has internal teeth 194 which engage external threads 176 on inner tubing hanger 174. Ratchet ring 184 has external load shoulders 196 which engage internal load shoulders 198 in load ring 182. Shear pins 202 serve to initially hold outer hanger 160 on inner tubing hanger 174 at the base of the external threads 176. Any number of shear pins 202 may be used. In a preferred embodiment, four shear pins 202 are distributed circumferentially around tubing hanger assembly 130. Shear pins 202 will shear after load ring 182 lands on load shoulder 188 (FIG. 1) and additional weight from conduit 170 (FIG. 5) is applied. This allows inner tubing hanger 174 to move downward relative to load ring 182. Ratchet ring 184 allows this downward movement because it is held initially in an expanded position such that it will not engage mandrel external threads 176 to prevent downward movement of inner tubing hanger 174.

Figure 7:
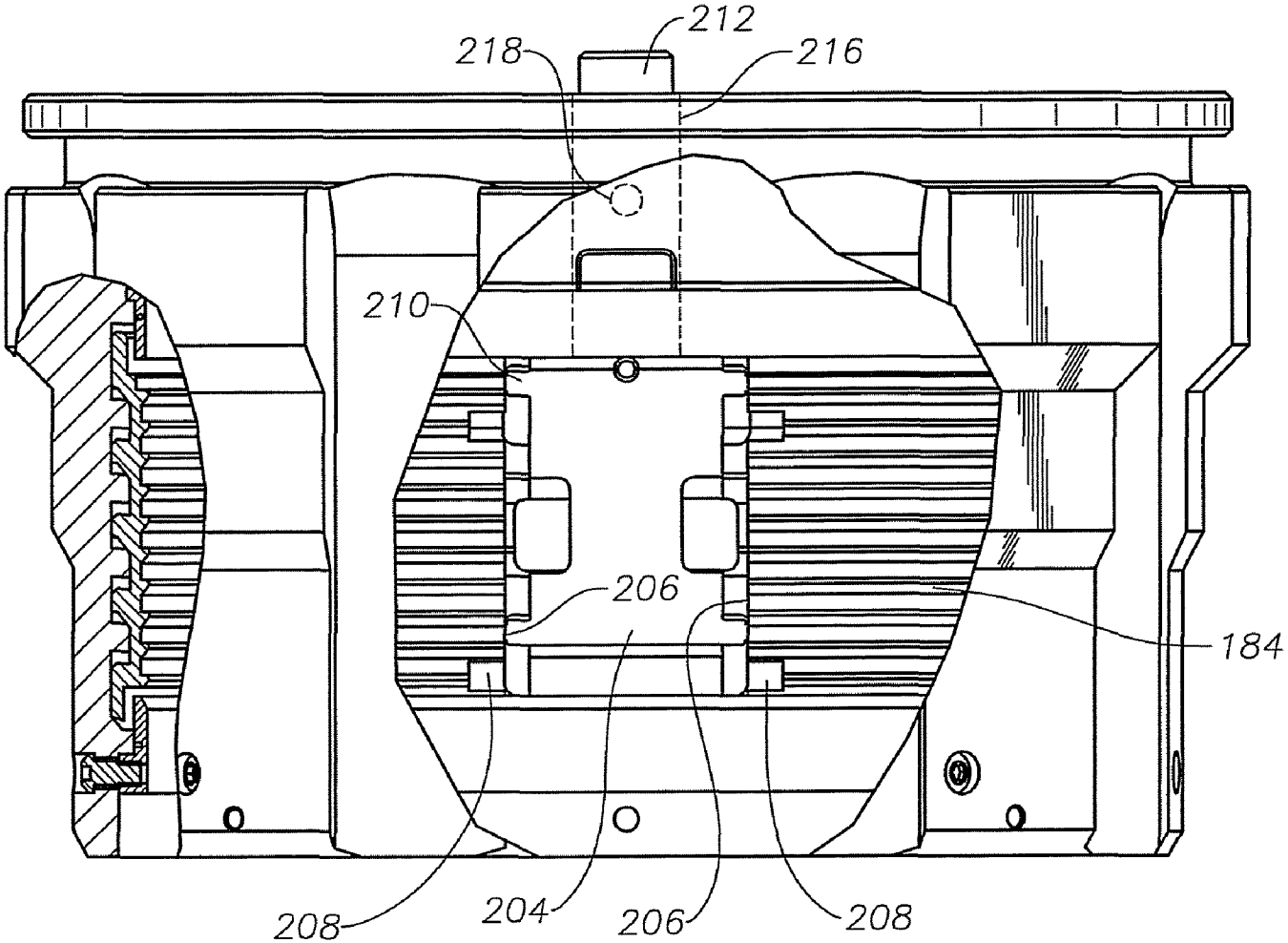
FIG. 7 is a partial cut-away side view of the ratchet ring of the tubing tensioning system of FIG. 1.
Figure 8:
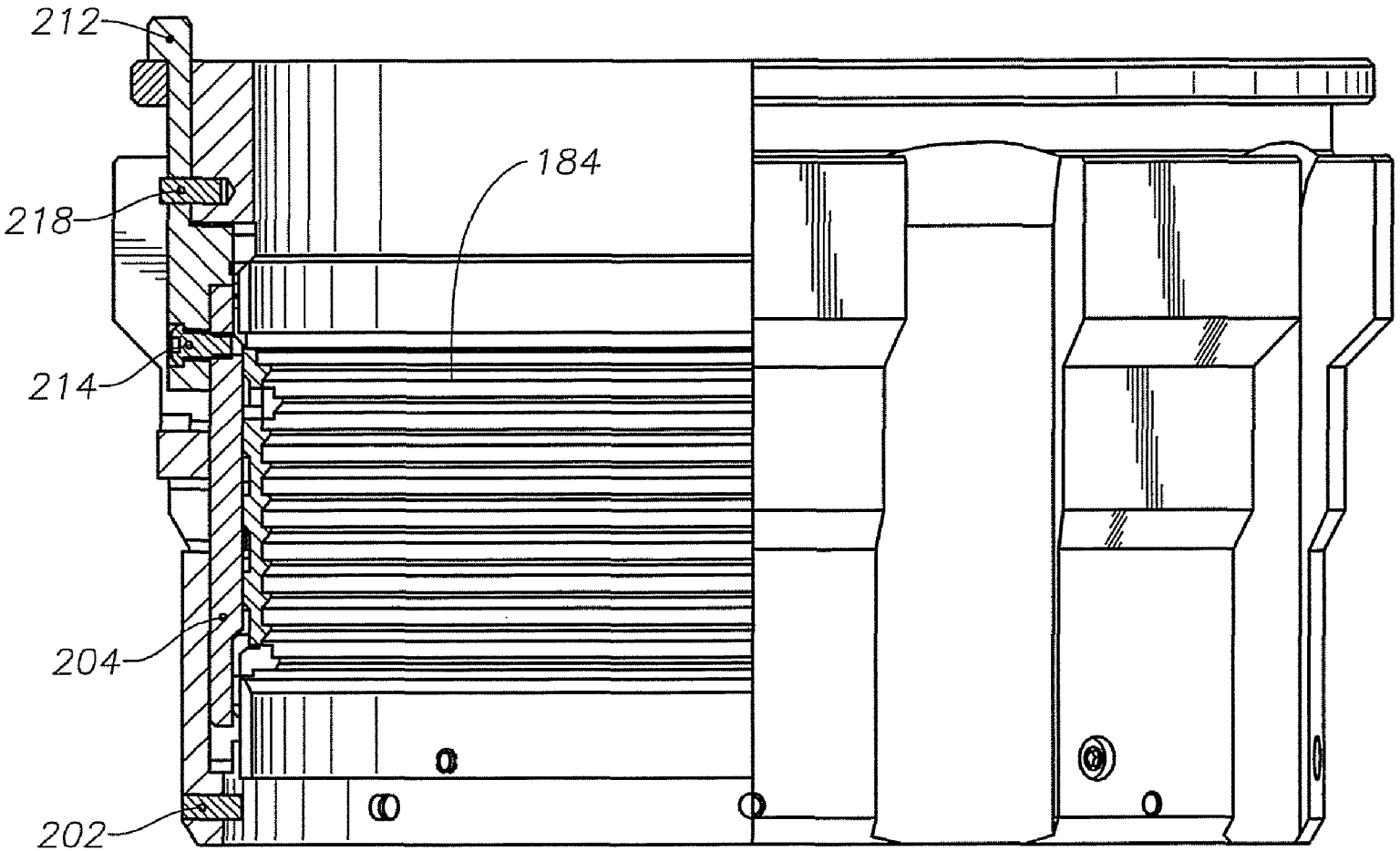
FIG. 8 is a partial sectional view of the ratchet ring of the tubing tensioning system of FIG. 1.

Referring to FIGS. 7 and 8, key 204 holds ratchet ring 184 in the expanded disengaged position. Key 204 is located in the split of ratchet ring 184, which is resilient. The split of ratchet ring 184 includes two opposed edges 206. Each edge 206 has a pair of rectangular recesses 208. Key 204 has two lugs 210, each extending laterally from an opposite side of the body of key 204. Lugs 210 will engage edges 206 when key 204 is in the upper position shown. This holds ratchet ring 184 in an expanded position. When key 204 is moved downward, lugs 210 enter recesses 208. This allows the resiliency of ratchet ring 184 to contract ratchet ring 184 to the engaged position.

The mechanism for releasing key 204 includes a rod 212 which extends upward and is secured by a pin or screw 214 to key 204. Rod 212 extends through a slot 216 formed in the load ring 182 and is held in the upper position by a key shear pin 218 to prevent premature activation of the ratchet ring 184. Slot 216 incorporates a hole through which pin or screw 214 extends. Key 204 is located on an inner recess portion of load ring 182 while rod 212 is located in slot 216 on the outer side of load ring 182. Rod 212 is pushed downward by a surface on the annular seal 146 (FIG. 3) when the annular seal 146 is set in place by the energizing ring 133 (FIG. 3).

Referring back to FIG. 2, wellhead housing 100 is a tubular member located at the upper end of a well, such as a gas storage well. It has a cylindrical bore 220, and may have one or more valve assemblies 222. Wellhead housing 100 has an upward facing shoulder 188 for landing tubing hanger assembly 130. Groove 192 (best shown in FIG. 3) is located on the inner diameter of the wellhead housing 100 for receiving a tubing hanger lock-ring 190 for securing outer tubing hanger 160 in place. Referring to FIG. 3, wellhead housing 100 also has a sealing surface 156, wherein annular seal 146 is pressed to form a seal against the sealing surface. Sealing surface 156 may or may not have circumferential grooves, or wickers, for forming a seal.

Referring to FIG. 2, in operation, inner tubing hanger 174 is located in the bore of tubing hanger outer body 160 and held in place by one or more shear pins 202. Casing or tubing conduit 170 is attached to inner tubing hanger 174, and is lowered through wellhead housing 100 into wellbore 172. Seal 146 (FIG. 3) is attached to energizing ring 133, which is attached to seal releasing latch ring 132, which in turn is attached to adapter sleeve 114. Adapter sleeve 114 is attached to the running tool outer body 110 of the STRT 101. STRT body 102 is attached to the communication collar 126, which in turn is attached to extended neck 178 of inner tubing hanger 174.

The assembly, comprising STRT 101, comm collar 126, inner tubing hanger 178, tubing hanger outer body 160, adapter sleeve 114, seal releasing latch ring 132, energizing ring 133, and seal 146, and further comprising tubing 170 attached to inner tubing hanger 178, is lowered into wellhead housing 100 on a conduit (not shown). The tubing hanger outer body 160 lands on the upward facing load shoulder 188

(FIG. 1) of wellhead housing 100. The weight of the tubing 170 pulling on the inner tubing hanger 174, and/or the force from the drill-string conduit (not shown) cause the shear pins 202 to shear. The now-landed tubing hanger outer body 160 ceases further downward movement.

STRT 101, comm collar 126, and inner tubing hanger 174 continue to move downward relative to wellhead housing 100 and now-stationary tubing hanger outer body 160. The portion of inner tubing hanger 174 having external grooves 176 passes through the tubing hanger outer body 160 and moves further downward. In an exemplary embodiment, inner tubing hanger 174 descends up to 1.2 meters after the tubing hanger outer body 160 has landed on the wellhead housing 100. Extended neck 178 of inner tubing hanger 174 and the lower portion of comm collar 126 may or may not pass through tubing hanger outer body 160, depending on the tensioning requirements of the tubing application.

Inner tubing hanger 174 is located a predetermined travel distance below tubing hanger outer body 160. The travel distance is calculated such that when the tubing is stretched by the amount of the travel distance, the tubing will have the desired amount of tension. The travel distance may be uniquely calculated for each application. In general, the travel distance is calculated to be greater than the thermal expansion distance expected for the tubing 170. The thermal expansion may occur during filling and discharge of a gas through the wellbore 172 in applications such as gas storage. The distance of thermal expansion may be a few centimeters or up to 1.2 meters, and thus inner tubing hanger 174 may be lowered anywhere from a few centimeters up to 1.2 meters below tubing hanger outer body 160. At a point generally coincident with the travel distance, the bottom end of the tubing 170 engages a latching device (not shown) in wellbore 172, such as a ratcheting latch, thus fixing the bottom end of the tubing 170 in place. The bottom end of tubing 170 and the latching device may be located in an underground storage well.

While the inner tubing hanger 174 is being lowered, an operator on the surface applies hydraulic pressure to the energizing hydraulic port 116. The hydraulic pressure is regulated by the operator to hold outer tubing hanger body 160 down on the load shoulder 188 in wellhead housing 100 without setting the seal 140 or energizing the lockdown ring 190. As the STRT body 102 is drawn up through the wellbore, hydraulic pressure on energizing port 116 is proportionately increased to maintain outer tubing hanger body 160 in position on load shoulder 188 without setting the seal 140 or energizing the lockdown ring 190. During the upward vertical travel, the inner tubing hanger 174 is pulled back through the outer tubing hanger 160, and thus through ratchet ring 184. Tension is increased in tubing 170 during this upward movement.

At the end of the pre-determined upward vertical travel, the inner tubing hanger 174 returns to a fixed point within the outer tubing hanger body 160 and at this point, the hydraulic pressure on the energizing port 116 is increased to the maximum, thereby actuating the outer housing 110 which acts as a ram to push the adapter sleeve 114, seal releasing latch ring 132, energizing ring 133, and seal 146 down relative to the STRT body 102. This force causes seal 146 to land in the seal pocket between the wellhead housing 100 and inner tubing hanger 174.

As seal 146 lands in the seal pocket, it causes lockdown ring 190 (FIG. 3) to expand outwards into the lockdown groove 192 (FIG. 3) of the wellhead housing 100. The seal 146 also engages rod 212 (FIG. 7), causing it to move down relative to outer tubing hanger 160. In some embodiments, seal 146 may actuate lockdown ring 190 and rod 212 before inner tubing hanger 174 is drawn back.

When rod 212 moves down, it pushes key 204 down, relative to ratchet ring 184. As lugs 210 clear edges 206 of ratchet ring 184, ratchet ring 184 collapses inward to its inwardly biased position and engages the external threads 176 of the inner tubing hanger 174 with the internal teeth 194 of the ratchet ring 184. The external load shoulders 196 of the ratchet ring 184 remain in contact with the internal load shoulders 198 of the outer tubing hanger 160. Thus weight and the subsequent tension on inner tubing hanger 174 is transferred to outer tubing hanger 160, via ratchet ring 184. The weight and tension is transferred from outer tubing hanger 160 to the wellhead housing 100 via load shoulder 188 (FIG. 1). The axial travel distance of inner tubing hanger 174 is known in advance, and thus the ratchet ring 184 may be sized and located to engage inner tubing hanger 174 at the desired location. Thus ratchet ring 184 has an axial length that may be much smaller than the travel distance. In some embodiments, the operator does not pull up on inner tubing hanger 174 after ratchet ring 184 has collapsed and thus the ratchet ring 184 does not actually ratchet, but rather holds the inner tubing hanger 174 in position. In other embodiments, the operator may pull up on inner tubing hanger 174 after ratchet ring 184 has collapsed, thus causing a ratcheting engagement.

With the weight and tension of the tubing now supported by wellhead housing 100, STRT 101 may be disengaged, leaving the tubing hanger assembly 130, comm collar 126, and seal assembly 140 in the wellbore.

While the invention has been shown or described in only some of its forms, it should be apparent to those skilled in the art that it is not so limited, but is susceptible to various changes without departing from the scope of the invention.

What is claimed is:

1. A method for applying tension to a wellbore tubing, the method comprising:

(a) releasably engaging an inner tubing hanger to an outer tubing hanger and attaching an upper end of a length of tubing to the inner tubing hanger;

(b) releasably connecting a running tool to the inner tubing hanger and lowering the tubing into a wellbore and landing the outer tubing hanger in a wellhead member;

(c) disengaging the inner tubing hanger from the outer tubing hanger and lowering the inner tubing hanger below the outer tubing hanger;

(d) latching the lower end of the tubing into a retainer in the wellbore;

(e) applying tension to the tubing by pulling upward;

(f) as the inner tubing hanger moves into engagement with the outer tubing hanger, latching the inner tubing hanger into the outer tubing hanger to hold the tubing in tension; and (g) using the running tool to energize a seal between the outer tubing hanger and the wellhead member.

2. The method of claim 1, wherein step (e) comprises restraining the outer tubing hanger from moving upward when tension is being applied to the tubing.

3. The method of claim 1, wherein step (a) comprises attaching a running tool to the inner tubing hanger and step (e) comprises lifting a portion of the running tool while holding the outer tubing hanger from upward movement.

4. The method of claim 1, further comprising disconnecting the running tool from the inner tubing hanger after the seal is energized and wherein step (c) further comprises collapsing an expandable ring between the inner and outer tubing hangers in response to energizing the seal, which latches the inner tubing hanger to the outer tubing hanger.

5. The method of claim 1, wherein the outer tubing hanger is affixed to the inner tubing hanger by at least one shear pin, and wherein the at least one shear pin is sheared by the weight of the tubing hanger and tubing after the outer tubing hanger lands in the wellhead housing.

6. The method of claim 1, wherein step (e) comprises pulling upward a predetermined distance.

7. A method for applying tension to a wellbore tubing, the method comprising:

(a) releasably engaging an inner tubing hanger to an outer tubing hanger, attaching an upper end of a length of tubing to the inner tubing hanger, and attaching a running tool to the inner tubing hanger;

(b) lowering the tubing into a wellbore and landing the outer tubing hanger in a wellhead member;

(c) disengaging the inner tubing hanger from the outer tubing hanger and lowering the inner tubing hanger below the outer tubing hanger;

(d) energizing a seal between the outer tubing hanger and the wellhead member;

(e) latching the lower end of the tubing into a retainer in the wellbore;

(f) applying tension to the tubing by pulling upward on the running tool;

(g) collapsing an expandable ring between the inner and outer tubing hangers in response to energizing the seal, (h) latching the inner tubing hanger into the outer tubing hanger with the expandable ring to hold the tubing in tension as the inner tubing hanger moves into engagement with the outer tubing hanger and (i) disconnecting the running tool from the inner tubing hanger after energizing the seal.

8. The method of claim 7, wherein step (f) comprises restraining the outer tubing hanger from moving upward when tension is being applied to the tubing.

9. The method according to claim 7, the method further comprising moving a resilient lock ring from a first position to a second position, wherein the first position allows movement of the outer tubing hanger relative to the wellhead member and the second position prevents movement of the outer tubing hanger relative to the wellhead member.

10. The method according to claim 8, wherein the running tool applies pressure to the seal and the seal causes the resilient lock ring to move from the first position to the second position.

11. The method according to claim 7, wherein the seal is not energized until after tension is applied to the tubing.

12. The method of claim 7, wherein step (f) comprises pulling upward a predetermined distance.

13. An apparatus for applying tension to tubing in a wellbore, the apparatus comprising:

a tubing hanger outer portion;

a tubing hanger inner portion that is adapted to be secured to a running tool and to the tubing;

a latch mechanism between the inner and outer portions that allows the inner portion to be lowered relative to the outer portion after the outer portion lands in a wellhead member and the inner portion is lifted back into engagement with the outer portion;

a seal mounted to the tubing hanger outer portion and movable by the running tool from an unenergized position when the tubing hanger outer portion lands in the wellhead member to an energized position for sealing between the wellhead member and the tubing hanger outer portion; and wherein movement of the seal to the energized position actuates the latch mechanism to latch the tubing hanger inner portion to the tubing hanger outer portion to prevent further downward movement of the tubing hanger inner portion relative to the tubing hanger outer portion, thereby maintaining tension in the tubing.

14. The apparatus according to claim 13 wherein the latch mechanism comprises a ratchet ring having a disengaged position, wherein the ratchet ring does not engage the tubing hanger inner portion, and an engaged position wherein the ratchet ring engages the tubing hanger inner portion.

15. The apparatus according to claim 14, further comprising a key having a first position for holding the ratchet ring in the disengaged position and a second position for allowing the ratchet ring to move to the engaged position, wherein the key moves from the first position to the second position responsive to the seal being set.

16. The apparatus according to claim 13, wherein the tubing hanger inner portion comprises a neck extending above the tubing hanger outer portion when the inner portion and the outer portion are latched together.

17. The apparatus according to claim 13, wherein the running tool is adapted to hold the tubing hanger outer portion in position while lowering the tubing hanger inner portion.

18. The apparatus according to claim 17, further comprising a resilient lock ring having a first position and a second position, wherein the running tool causes the lock ring to move from the first position to the second position, and wherein the second position prevents upward movement of the tubing hanger outer portion.

19. The apparatus according to claim 18, wherein the running tool exerts pressure on the seal without energizing the seal, and wherein the seal moves the lock ring from the first to the second position and holds the lock ring in the second position while lifting the tubing hanger inner portion.

20. The apparatus according to claim 13, wherein the tubing hanger inner portion is adapted to be lifted back a predetermined distance.

* * * * *